US007239248B2

(12) United States Patent
Fong

(10) Patent No.: US 7,239,248 B2
(45) **Date of Patent: *Jul. 3, 2007**

(54) LEVEL/POSITION SENSOR AND RELATED ELECTRONIC CIRCUITRY FOR INTERACTIVE TOY

(76) Inventor: Peter Sui Lun Fong, 297F S. Atlantic Blvd., Monterey Park, CA (US) 91754

( * ) Notice: Subject to any disclaimer, the term of this patent is extended or adjusted under 35 U.S.C. 154(b) by 411 days.

This patent is subject to a terminal disclaimer.

(21) Appl. No.: 10/872,015

(22) Filed: Jun. 18, 2004

(65) Prior Publication Data

US 2004/0239518 A1 Dec. 2, 2004

Related U.S. Application Data

(63) Continuation-in-part of application No. 10/628,007, filed on Jul. 25, 2003, now Pat. No. 6,995,680, and a continuation-in-part of application No. 10/179,569, filed on Jun. 25, 2002, now Pat. No. 6,909,374, which is a continuation of application No. 09/568,900, filed on May 11, 2000, now Pat. No. 6,437,703, which is a continuation-in-part of application No. 09/478,388, filed on Jan. 6, 2000, now Pat. No. 6,377,187.

(60) Provisional application No. 60/398,372, filed on Jul. 25, 2002.

(51) Int. Cl.
*G08B 21/00* (2006.01)

(52) U.S. Cl. ..... 340/686.1; 340/689; 340/573.1; 340/691.2; 200/52 R; 200/61.52; 200/61.45 R; 73/652; 73/654

(58) Field of Classification Search ..... 340/686.1, 340/689, 573.1, 692; 200/61.45 R, 61.52; 73/652, 654, 651, 653, 657, 655, 649; 434/311
See application file for complete search history.

(56) References Cited

U.S. PATENT DOCUMENTS

| | | | |
|---|---|---|---|
| 3,460,028 | A | 8/1969 | Beaver |
| 3,601,729 | A | 8/1971 | Hierta |
| 4,321,438 | A | 3/1982 | Emenegger |
| 4,339,747 | A | 7/1982 | Maybee |
| 4,390,928 | A | 6/1983 | Runge |
| 4,503,299 | A | 3/1985 | Henrard |
| 4,644,662 | A | 2/1987 | Anderson et al. |
| 4,651,613 | A | 3/1987 | Harrison |
| 4,672,753 | A | 6/1987 | Kent et al. |
| 4,700,479 | A | 10/1987 | Saito et al. |

(Continued)

*Primary Examiner*—Anh V. La
(74) *Attorney, Agent, or Firm*—Stetina Brunda Garred & Brucker

(57) ABSTRACT

A sensor for use in an interactive electronic device. The sensor is operative to generate a plurality of different output signals corresponding to respective positions of the sensor relative to a reference plane. The movement of the sensor relative to the reference plane facilitates the movement of one or more actuation balls of respective switches of the sensor, which in turn results in the generation of differing conditions or output signals corresponding to the particular pattern of electrical or conductive connection between a pad and terminals of the sensor facilitated by the switches thereof.

23 Claims, 20 Drawing Sheets

U.S. PATENT DOCUMENTS 4,701,146 A * 10/1987 Swenson ..... 446/130
4,803,342 A 2/1989 Steers et al.
4,811,492 A 3/1989 Kakuta et al.
4,866,850 A 9/1989 Kelly et al.
4,925,189 A 5/1990 Braeunig
4,957,291 A * 9/1990 Miffitt et al. ..... 463/9
4,961,579 A * 10/1990 Thompson et al. ..... 273/153 R
4,973,052 A * 11/1990 Conti ..... 273/444
5,001,466 A 3/1991 Orlinsky et al.
5,026,157 A 6/1991 Winckler
5,059,958 A 10/1991 Jacobs et al.
5,130,693 A 7/1992 Gigandet
5,168,264 A 12/1992 Agustin
5,195,746 A 3/1993 Boyd et al.
5,209,343 A 5/1993 Romano
5,290,198 A 3/1994 Nakayama
5,300,921 A 4/1994 Hoch et al.
5,402,107 A 3/1995 Rencavage
5,434,559 A 7/1995 Smiley et al.
5,450,049 A 9/1995 Bachmann
5,529,070 A 6/1996 Augustine et al.
5,610,338 A 3/1997 Kato et al.
5,646,601 A 7/1997 Wallace et al.
5,694,340 A 12/1997 Kim
5,703,567 A 12/1997 Cleveland
5,798,912 A 8/1998 Brown et al.
5,992,849 A 11/1999 Olti et al.
6,106,398 A 8/2000 Davis
6,157,898 A 12/2000 Marinelli
6,200,219 B1 3/2001 Rudell et al.
6,215,978 B1 4/2001 Ruzic et al.
6,272,925 B1 * 8/2001 Watson ..... 73/504.12
6,340,980 B1 1/2002 Ho
6,377,187 B1 4/2002 Fong
6,399,941 B1 6/2002 Nakagaki et al.
6,437,703 B1 8/2002 Fong

* cited by examiner

LEVEL/POSITION SENSOR AND RELATED ELECTRONIC CIRCUITRY FOR INTERACTIVE TOY

CROSS-REFERENCE TO RELATED APPLICATIONS

The present application is a continuation-in-part of U.S. application Ser. No. 10/628,007 entitled LEVEL/POSITION SENSOR AND RELATED ELECTRONIC CIRCUITRY FOR INTERACTIVE TOY filed Jul. 25, 2003 now U.S. Pat. No. 6,995,680, which claims priority to U.S. Provisional Application Ser. No. 60/398,372 entitled LEVEL/POSITION SENSOR AND RELATED ELECTRONIC CIRCUITRY FOR INTERACTIVE TOY filed Jul. 25, 2002, and is a continuation-in-part of U.S. application Ser. No. 10/179,569 entitled LEVEL/POSITION SENSOR AND RELATED ELECTRONIC CIRCUITRY FOR INTERACTIVE TOY filed Jun. 25, 2002 now U.S. Pat. No. 6,909,374, which is a continuation of U.S. application Ser. No. 09/568,900 entitled LEVEL/POSITION SENSOR AND RELATED ELECTRONIC CIRCUITRY FOR INTERACTIVE TOY filed May 11, 2000 and issued as U.S. Pat. No. 6,437,703 on Aug. 20, 2002, which is a continuation-in-part of U.S. application Ser. No. 09/478,388 entitled LEVEL/POSITION SENSOR AND RELATED ELECTRONIC CIRCUITRY FOR INTERACTIVE TOY filed Jan. 6, 2000 issued as U.S. Pat. No. 6,377,187 on Apr. 23, 2002, the disclosures of which are incorporated herein by reference.

STATEMENT RE: FEDERALLY SPONSORED RESEARCH/DEVELOPMENT

Not Applicable

BACKGROUND OF THE INVENTION

The present application relates generally to interactive electronic devices, and more particularly to a uniquely configured sensor and associated electronic circuitry which may be incorporated into interactive electronic toys and games (including dolls and remote controllers such as joysticks) and is operative to produce various visual and/or audible outputs or signal transmissions corresponding to the level/position of the toy relative to a prescribed plane.

There is currently known in the prior art a multitude of interactive electronic toys which are capable of producing a wide variety of visual and/or audible outputs. In the prior art toys, these outputs are typically triggered as a result of the user (e.g., a child) actuating one or more switches of the toy. The switch(es) of the prior art toys are most typically actuated by pressing one or more buttons on the toy, opening and/or closing a door or a hatch, turning a knob or handle, inserting an object into a complementary receptacle, etc. In certain prior art interactive electronic toys, the actuation of the switch is facilitated by a specific type of movement of the toy. However, in those prior art electronic toys including a motion actuated switch, such switch is typically capable of generating only a single output signal as a result of the movement of the toy.

The present invention provides a uniquely configured sensor and associated electronic circuitry which is particularly suited for use in interactive electronic toys and games, including dolls and remote controllers such as joysticks. The present sensor is specifically configured to generate a multiplicity of different output signals which are a function of (i.e., correspond to) the level/position of the toy relative to a prescribed plane. Thus, interactive electronic toys and games incorporating the sensor and associated electronic circuitry of the present invention are far superior to those known in the prior art since a wide variety of differing visual and/or audible outputs and/or various signal transmissions may be produced simply by varying or altering the level/position of the toy relative to a prescribed plane. For example, the incorporation of the sensor and electronic circuitry of the present invention into an interactive electronic toy such as a spaceship allows for the production of differing visual and/or audible outputs as a result of the spaceship being tilted in a nose-up direction, tilted in a nose-down direction, banked to the left, banked to the right, and turned upside down. As indicated above, the output signals generated by the sensor differ according to the level/position of the sensor relative to a prescribed plane, with the associated electronic circuitry of the present invention being operative to facilitate the production of various visual and/or audible outputs corresponding to the particular output signals generated by the sensor.

If incorporated into a joystick or other remote controller, the present sensor and associated electronic circuitry may be configured to facilitate the production of the aforementioned visual and/or audible outputs, and/or generate electrical/electronic signals, radio signals, infrared signals, microwave signals, or combinations thereof which may be transmitted to another device to facilitate the control and operation thereof in a desired manner. The frequency and/or coding of the radio, microwave, or electrical/electronic signals and the coding of the infrared signals transmitted from the joystick or other remote controller would be variable depending upon the level or position of the same relative to a prescribed plane. Moreover, the present electronic circuitry may be specifically programmed to memorize or recognize a prescribed sequence of movements of the sensor relative to a prescribed plane. More particularly, a prescribed sequence of states or output signals generated by the sensor corresponding to a prescribed sequence of movements thereof, when transmitted to the electronic circuitry, may be used to access a memory location in the electronic circuitry in a manner triggering or implementing one or more pre-programmed visual and/or audible functions or effects and/or the transmission of various electrical (hard wired), infrared, radio, or microwave signals to another device for communication and/or activation of various functions thereof. These, and other unique attributes of the present invention, will be discussed in more detail below.

BRIEF SUMMARY OF THE INVENTION

In accordance with the present invention, there is provided a sensor for use in an interactive electronic device. The sensor is operative to generate a plurality of different output signals corresponding to respective positions of the sensor relative to a reference plane. The movement of the sensor relative to the reference plane facilitates the movement of one or more actuation balls of respective switches of the sensor, which in turn results in the generation of differing conditions or output signals corresponding to the particular pattern of electrical or conductive connection between a pad and terminals of the sensor facilitated by the switches thereof.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
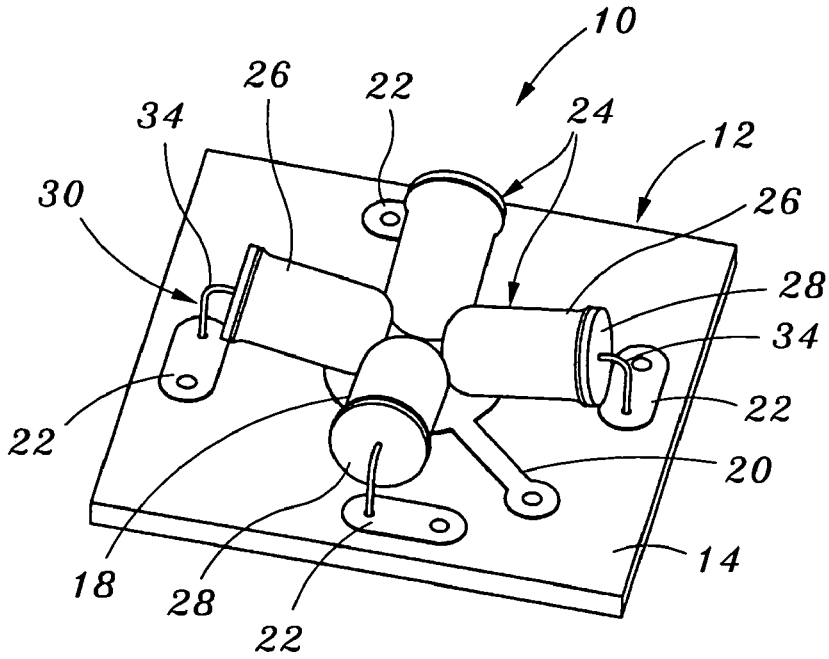
FIG. 1 is a top perspective view of a sensor constructed in accordance with a first embodiment of the present invention.
Figure 2:
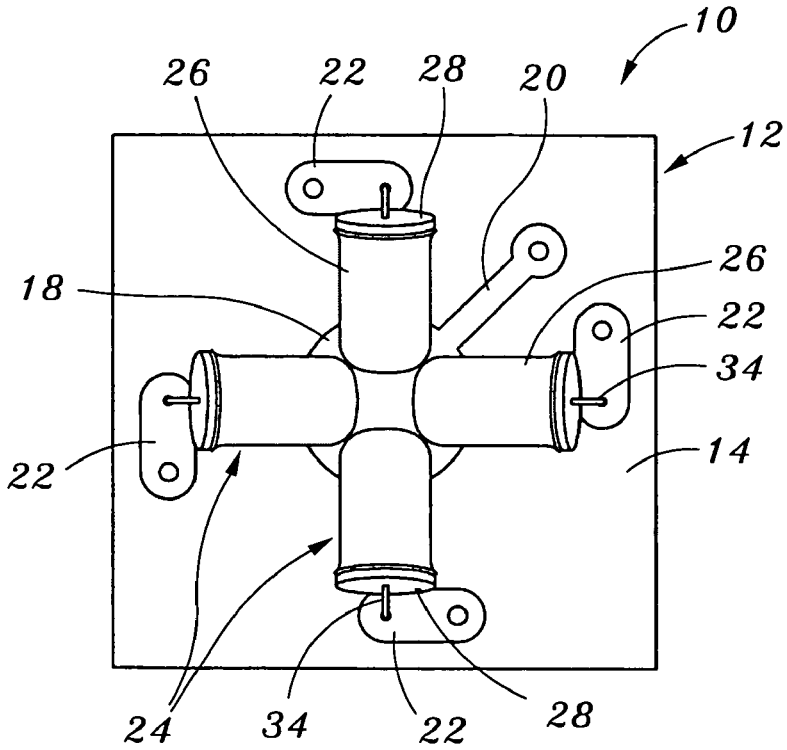
FIG. 2 is a top plan view of the sensor of the first embodiment.

Referring now to the drawings wherein the showings are for purposes of illustrating preferred embodiments of the present invention only, and not for purposes of limiting the same, FIGS. 1-4 perspectively illustrate a sensor 10 constructed in accordance with a first embodiment of the present invention. The sensor 10 comprises a base plate 12 which, as seen in FIGS. 1-4, has a generally quadrangular (e.g., square) configuration. The base plate 12 defines a generally planar top surface 14 and an opposed, generally planar bottom surface 16. Formed in the approximate center of the top surface 14 of the base plate 12 is a circularly configured conductive pad 18. Integrally connected to and extending radially from the pad 18 is an elongate conductive trace 20, the distal end of which has an enlarged, generally circular configuration. Also disposed on the top surface 14 are four identically configured, elongate conductive terminals 22. Each of the terminals 22 extends along a respective one of the peripheral edge segments of the base plate 12, with the terminals 22 thus being spaced from each other at equidistant intervals of approximately ninety degrees. The pad 18, trace 20, and terminals 22 are each preferably fabricated from a conductive metallic material, such as copper. The formation of the pad 18, trace 20 and terminals 22 may be facilitated through the completion of a conventional etching process subsequent to the application of a metal layer to the top surface 14 of the base plate 12. The base plate 12 is itself preferably fabricated from a non-conductive, insulative material.

Figure 5:
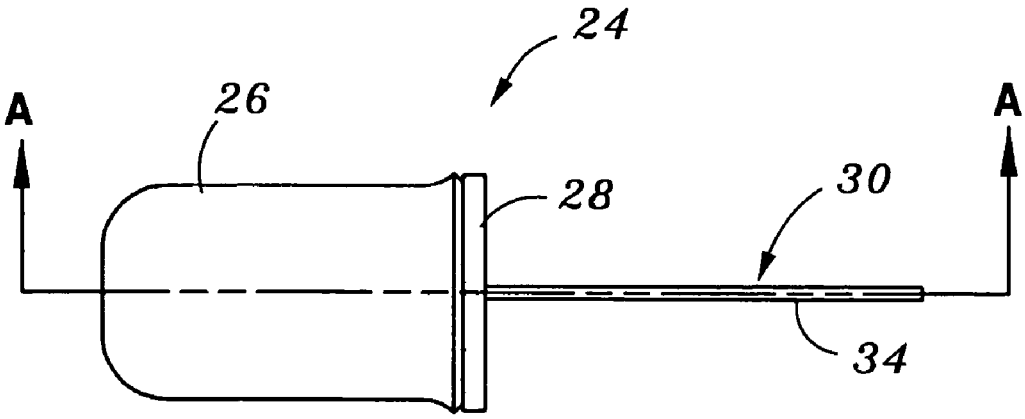
FIG. 5 is a side elevational view of a switch of the sensor of the first embodiment.
Figure 6:
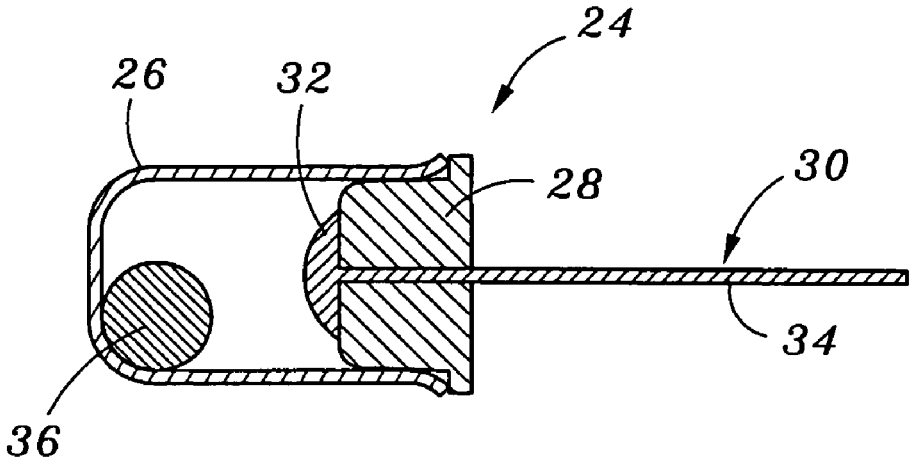
FIG. 6 is a cross-sectional view of the switch taken along line A-A of FIG. 5.
Figure 7:
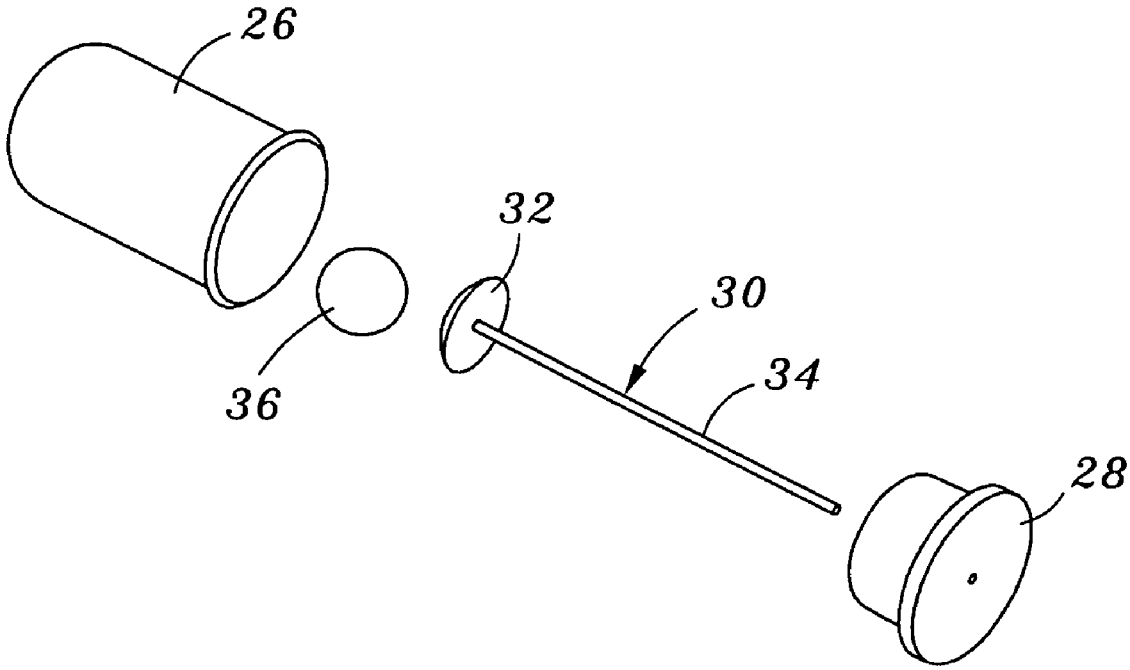
FIG. 7 is an exploded view of the switch.

The sensor 10 of the first embodiment further comprises a plurality (e.g., four) tubular switches 24, one of which is shown in FIGS. 5-7. Each switch 24 comprises a tubular, generally cylindrical body 26 having one open end and one closed end. The body 26 is preferably fabricated from a conductive metal material for reasons which will be discussed in more detail below. In addition to the body 26, each switch 24 comprises a closure member or plug 28 which is advanced into and effectively seals or encloses the open end of the body 26 as best seen in FIG. 6. The plug 28 is preferably fabricated from a non-conductive, insulative material. Advanced through the plug 28 is a contact pin 30 of the switch 24. The contact pin 30 has an enlarged, button-like inner end 32 and an elongate pin portion 34 which extends axially from the inner end 32. As further seen in FIG. 6, the pin portion 34 of the contact pin 30 is advanced through the plug 28 such that the inner end 32 is abutted against the inner surface of the plug 28 and thus resides within the enclosed interior of the body 26. Like the body 26, the contact pin 30 is also fabricated from a conductive metal material.

Each switch 24 further comprises a spherical actuation ball 36 which, as seen in FIG. 6, is captured in the enclosed hollow interior of the body 26. As will be recognized, the actuation ball 36 is disposed within the interior of the body 26 prior to the advancement of the plug 28 into the open end thereof. The actuation ball 36 is itself fabricated from a conductive metal material. It is further contemplated that the conductive metal material used to fabricate the contact pin 30 and/or the actuation ball 36 of each switch 24 will also be ferromagnetic. In this regard, in each switch 24, it is desirable to create a force of magnetic attraction between the actuation ball 36 and the inner end 32 of the contact pin 30. However, despite such magnetic attraction, the relatively small contact surface area achievable between the inner end 32 and the actuation ball 36 still allows for the actuation ball 36 to be separated from the inner end 32 under conditions which will be described in more detail below. Those of ordinary skill in the art will recognize that each switch 24 may be configured such that neither the contact pin 30 nor the actuation ball 36 thereof is fabricated from a ferromagnetic material. Moreover, the body 26 may be alternatively configured to define opposed open ends, rather than one closed end. If both ends of the body 26 are open, one open end can be enclosed by the plug 28 in the above-described manner, with the remaining open end being enclosed by a plug fabricated from an electrically conductive material.

Referring again to FIGS. 1-4, the sensor 10 is assembled by orienting the switches 24 such that portions of the bodies 26 adjacent the closed ends thereof are brought into direct, abutting contact with the pad 18 of the base plate 12 in the manner best shown in FIG. 3. Additionally, the pin portion 34 of the contact pin 30 of each switch 24 is bent and advanced through a corresponding aperture which extends through the base plate 12 and a respective one of the terminals 22. Importantly, the pin portion 34 of each contact pin 30 is conductively secured to a respective one of the terminals 22 such that the open end of the body 26 which is enclosed by the plug 28 is slightly elevated relative to the top surface 14 of the base plate 12 in the manner also shown in FIG. 3. Thus, the body 26 of each switch 24 extends slightly angularly upwardly from the pad 18 outwardly toward a respective peripheral edge segment of the base plate 12. It is contemplated that such angular elevation of each switch 24 may be any elevation greater than zero degrees, and may be specifically set or established to accomplish a prescribed function or result.

Due to the manner in which the switches 24 are interfaced to the base plate 12 as described above, the bodies 26 of the switches 24 are each in conductive contact with the pad 18, with the contact pins 30 of the switches 24 being in conductive contact with respective ones of the terminals 22. Within each switch 24, the actuation ball 36 is in conductive contact with the body 26, and selectively placeable into conductive contact with the inner end 32 of the corresponding contact pin 30.

Figure 3:
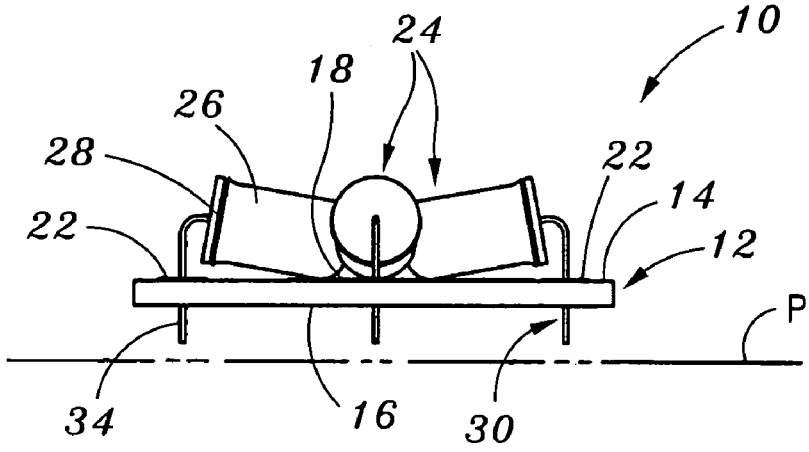
FIG. 3 is a side elevational view of the sensor of the first embodiment.
Figure 4:
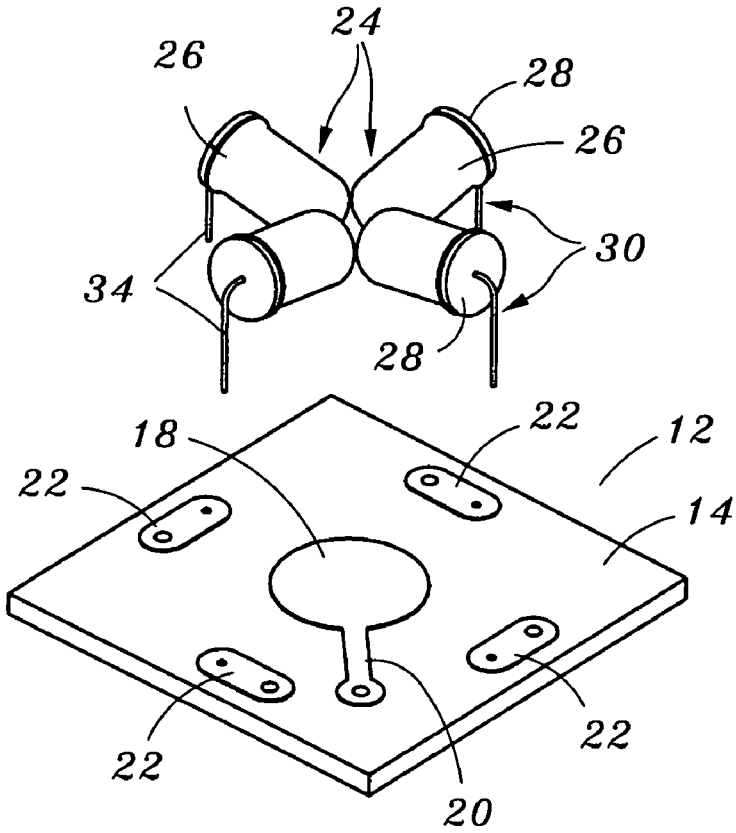
FIG. 4 is an exploded view of the sensor of the first embodiment.

In the sensor 10, each switch 24 is selectively placeable into an on or off state. When the sensor 10 is oriented such that the base plate 12 extends in spaced, generally parallel relation to a reference plane P as shown in FIG. 3, the actuation ball 36 of each switch 24 will roll or move to the closed end of the body 26 thereof, in essentially the manner shown in FIG. 6. The movement of each actuation ball 36 to the closed end of the corresponding body 26 occurs as a result of the angular inclination of each body 26 as described above. In this neutral position wherein the actuation balls 36 are all disposed against the closed ends of the corresponding bodies 26, no conductive connection is achieved between the pad 18 and any of the terminals 22. In this regard, though the pad 18 is in conductive contact with each body 26, and each body 26 in conductive contact with a corresponding actuation ball 36, the gap separating each actuation ball 36 from the inner end 32 of the corresponding contact pin 30 effectively breaks the conductive electrical path to the corresponding terminal 22.

As will be recognized, the movement of the sensor 10 so as to cause the base plate 12 to be shifted out of parallel relation to the reference plane P will cause the actuation ball 36 of at least one of the switches 24 to roll away from the closed end of the corresponding body 26 and into contact with the inner end 32 of the corresponding contact pin 30. When such contact occurs, a continuous conductive path is created, such path being defined by the conductive contact between the pad 18 and the body 26, the conductive contact between the body 26 and the actuation ball 36, the conductive contact between the actuation ball 36 and the inner end 32 of the contact pin 30, and the conductive contact between the pin portion 34 of the contact pin 30 and the corresponding terminal 22. Advantageously, the preferred magnetic attraction between the actuation ball 36 and contact pin 30 facilitates movement of the actuation ball 36 toward the inner end 32 even upon only a very slight shift of the base plate 12 out of parallel relation to the reference plane P. Thus, the force of magnetic attraction overcomes, in large measure, the bias of the actuation ball 36 toward the closed inner end of the body 26 occurring as a result of the angular orientation of each body 26 relative to the top surface 14 of the base plate 12. Such angular orientation is desirable to assure that no conductive communication is achieved between the pad 18 and any of the terminals 22 when the sensor 10 is in a neutral position, i.e., the base plate 12 is disposed in generally parallel relation to the reference plane P.

As will be recognized, depending on the manner in which the base plate 12 is tilted or shifted out of parallel relation to the reference plane P, the actuation balls 36 of at least two of the switches 24 may be brought into conductive contact with corresponding ones of the contact pins 30 at the same time. Thus, as will be recognized, the sensor 10 has the capability of generating a multiplicity of different conditions or states depending on the angular displacement of the base plate 12 relative to the reference plane P. As indicated above, when the base plate 12 is in its neutral position and thus disposed in substantially parallel relation to the reference plane P, no output signal is generated by the sensor 10 due to the absence of conductive communication between the actuation balls 36 and the terminals 22. However, the shifting of the position of the base plate 12 relative to the reference plane P will cause one or more different output signals to be generated by the sensor 10, depending on which actuation ball(s) 36 are brought into conductive contact with the corresponding control pin(s) 30. In this regard, the sensor 10 is preferably used in conjunction with electronic circuitry which has the functional capability of producing certain visual and/or audible effects, depending on which output signal(s) are transmitted thereto from the sensor 10. It is contemplated that such electronic circuitry will be programmable, and may be programmed to produce a selected effect upon a prescribed sequence of output signals being transmitted thereto from the sensor 10. As indicated above, the sensor 10 and the complimentary electronic circuitry may be integrated into any one of a multiplicity of different interactive devices, one such exemplary device being an interactive toy. Exemplary configurations of the electronic circuitry which may be used in conjunction with the sensor 10 are described in detail in the above-recited parent applications, the pertinent disclosures of which are expressly incorporated herein by reference.

Though not shown, it is contemplated that each switch 24 may alternatively be configured to include more than one actuation ball 36. The inclusion of more than one actuation ball 36 within the body 26 of each switch 24 provides more weight, which in turn assists in the movement of the actuation balls 36 toward a corresponding contact pin 30 upon the movement of the base plate 12 out of parallel relation to the reference plane P. Even if a single actuation ball 36 is included in each switch 24 as shown in FIG. 6, as indicated above, the relatively small contact surface area that exists between the actuation ball 36 and the inner end 32 of the corresponding contact pin 30 still allows for relative easy separation of the contact ball 36 from the inner end 32 despite any force of magnetic attraction therebetween when such separation is compelled by the position of the base plate 12 relative to the reference plane P.

Referring now to FIGS. 8-11, there is shown a sensor 10*a* constructed in accordance with a second embodiment of the present invention. The sensor 10*a* of the second embodiment is similar in structure and function to the sensor 10 of the first embodiment described above. Thus, only the distinctions or variations between the sensors 10, 10*a* will be discussed below.

Figure 8:
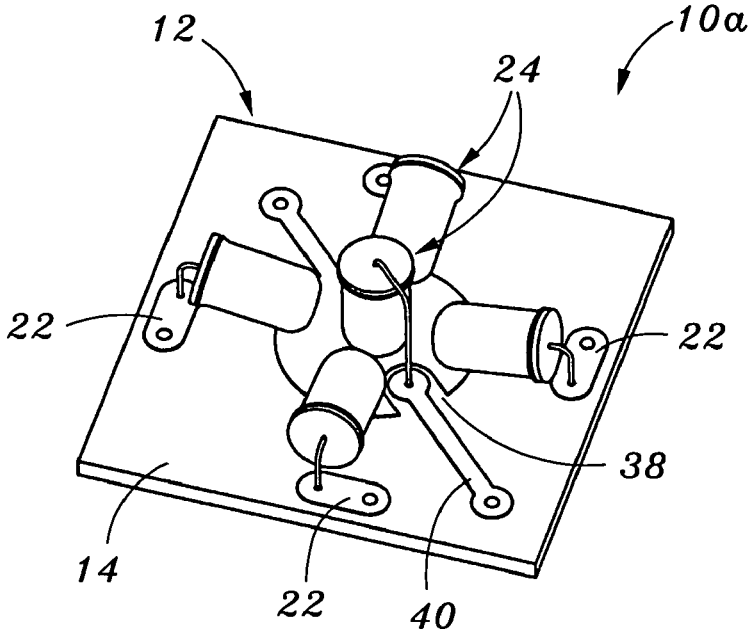
FIG. 8 is a top perspective view of a sensor constructed in accordance with a second embodiment of the present invention.
Figure 9:
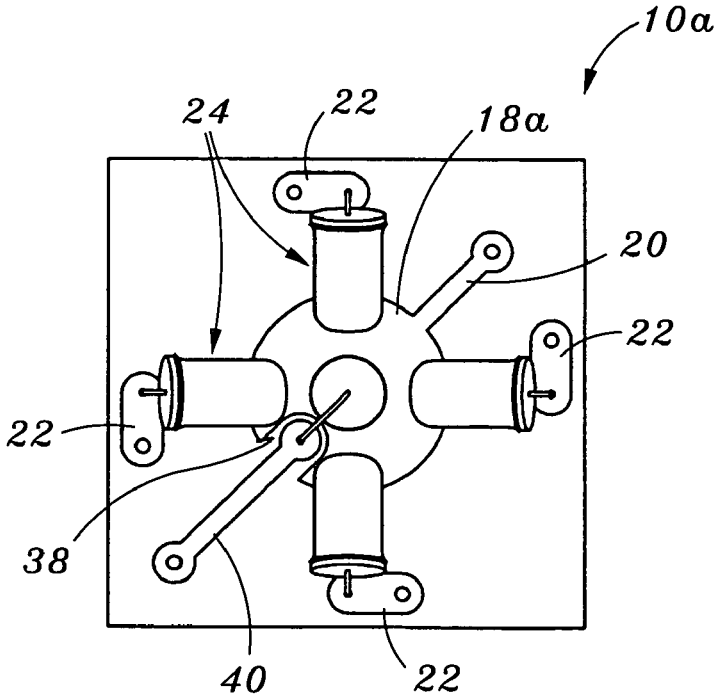
FIG. 9 is a top plan view of the sensor of the second embodiment.
Figure 10:
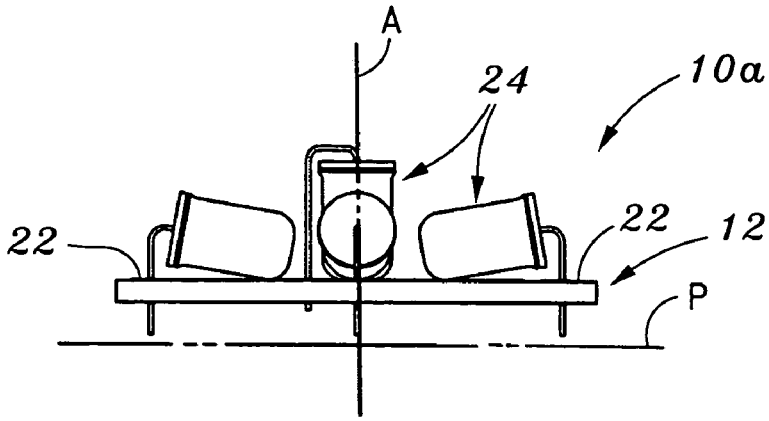
FIG. 10 is a side elevational view of the sensor of the second embodiment.
Figure 11:
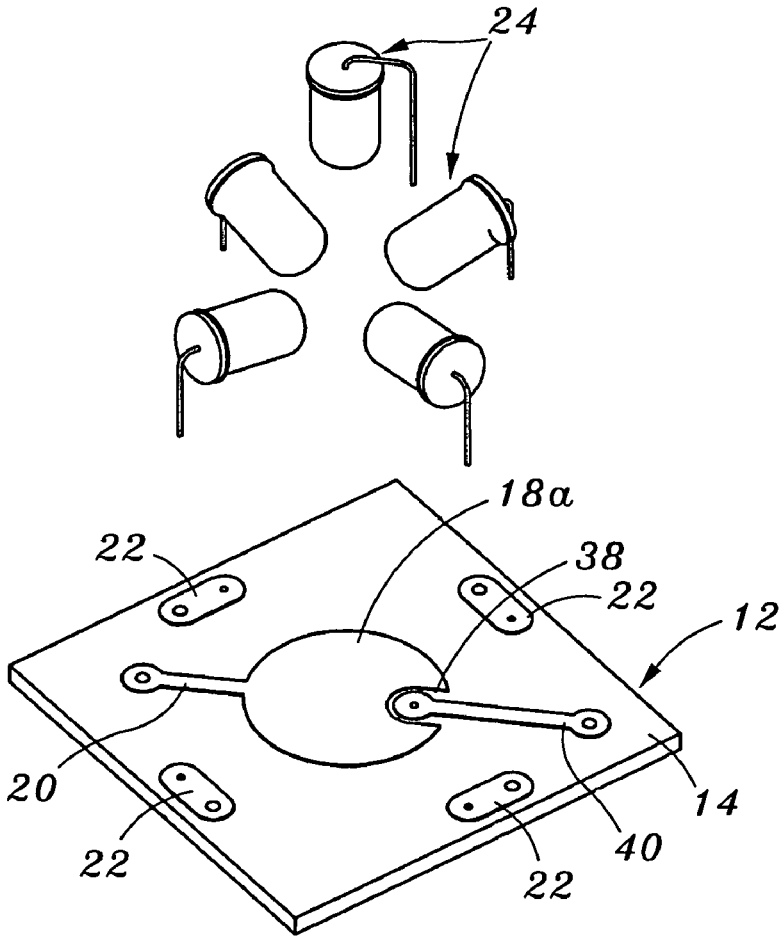
FIG. 11 is an exploded view of the sensor of the second embodiment.
Figure 12:
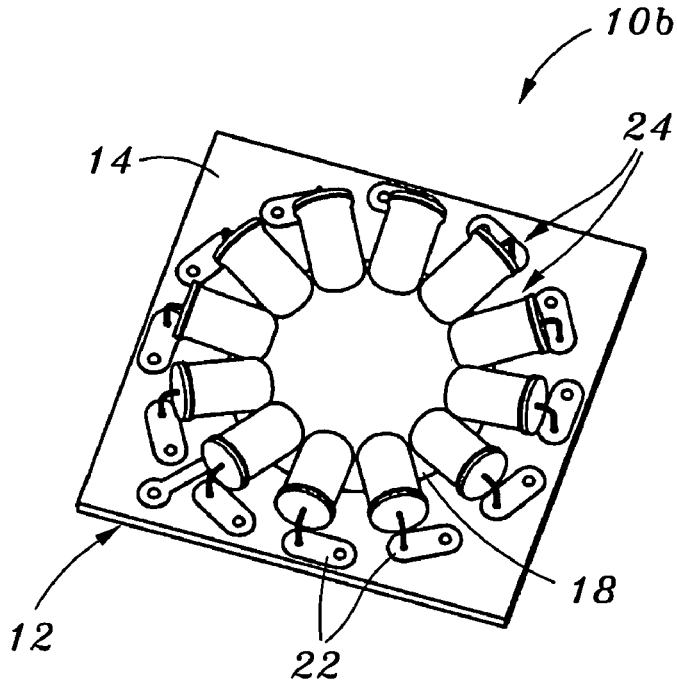
FIG. 12 is a top perspective view of a sensor constructed in accordance with a third embodiment of the present invention.

The primary distinction between the sensor 10*a* of the second embodiment and the sensor 10 of the first embodiment is the inclusion of five switches 24 in the sensor 10*a*, in comparison to the four switches 24 included in the sensor 10. As best seen in FIGS. 9 and 10, the extra fifth switch 24 in the sensor 10*a* is oriented so as to extend along a switch axis A which itself extends generally perpendicularly relative to the top surface 14 of the base plate 12. To accommodate the fifth switch 24, the remaining four switches 24 in the sensor 10*a* are spaced slightly further from each other in comparison to the switches 24 of the sensor 10, thus defining a central gap or opening of sufficient size to accommodate the switch 24 extending along the axis A. In the sensor 10*a*, the closed end of the body 26 of the switch 24 extending along the axis A directly abuts the pad 18*a* of the base plate 12. As seen in FIGS. 8, 9 and 11, the configuration of the pad 18*a* in the sensor 10*a* varies slightly from that of the pad 18 of the sensor 10. More particularly, the pad 18*a* has a notch 38 formed in the periphery thereof. The notch 38 is sized and configured to accommodate a portion of an elongate, metallic conductive trace 40 which is formed on the top surface 14 of the base plate 12. Also formed on the top surface 14 are the pad 18*a*, the trace 20 integrally connected to the pad 18*a*, and terminals 22. As seen in FIGS. 8 and 9, the pin portion 34 of the contact pin 30 of the fifth switch 24 oriented along the axis A is advanced through an aperture which itself extends through the base plate 12 of the sensor 10*a* and the trace 40 formed on the top surface 14 thereof. Subsequent to such advancement, the pin portion 34 of the contact pin 30 of the fifth switch 24 is electrically or conductively connected to the trace 40, in the same manner the pin portions 34 of the contact pins 30 of the remaining four switches 24 are electrically or conductively connected to respective ones of the terminals 22.

The functionality of the sensor 10*a* of the second embodiment is similar to that described above in relation to the sensor 10 of the first embodiment. However, the sensor 10*a*, due its inclusion of the fifth switch 24 extending along the axis A, has the additional capability of distinguishing whether the sensor 10*a* is right side up or upside down relative to the reference plane P shown in FIG. 10. As depicted in FIG. 10, the sensor 10*a* is right side up relative to the reference plane P. In this orientation, the actuation ball 36 of the switch 24 extending along the axis A is not in conductive contact with the inner end 32 of the corresponding contact pin 30, the actuation ball 36 actually being separated from the inner end 32 and resting directly against the closed end of the body 26. If the sensor 10*a* were to be inverted so as to be oriented upside down relative to the reference plane P, the actuation ball 36 of the switch 24 extending along the axis A would be caused to fall or roll downwardly into conductive contact with the inner end 32 of the corresponding contact pin 30. As will be recognized, the electronic circuitry used in conjunction with the sensor 10*a* is adapted to accept and to process the additional output signal generated by the fifth switch 24 extending along the axis A.

Figure 13:
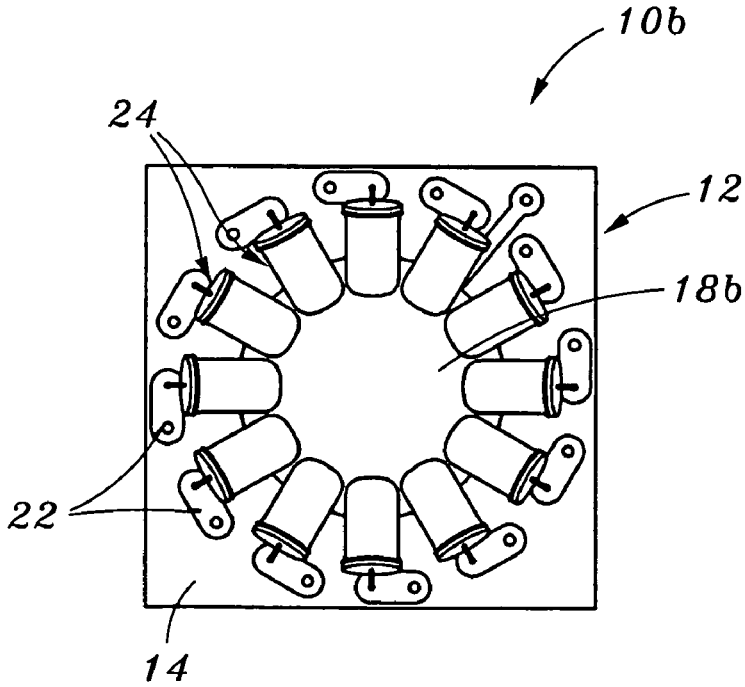
FIG. 13 is a top plan view of the sensor of the third embodiment.
Figure 14:
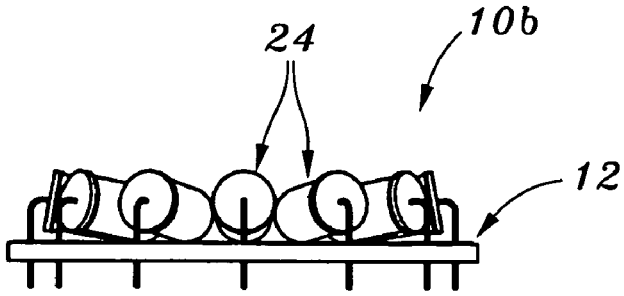
FIG. 14 is a side elevational view of the sensor of the third embodiment.
Figure 15:
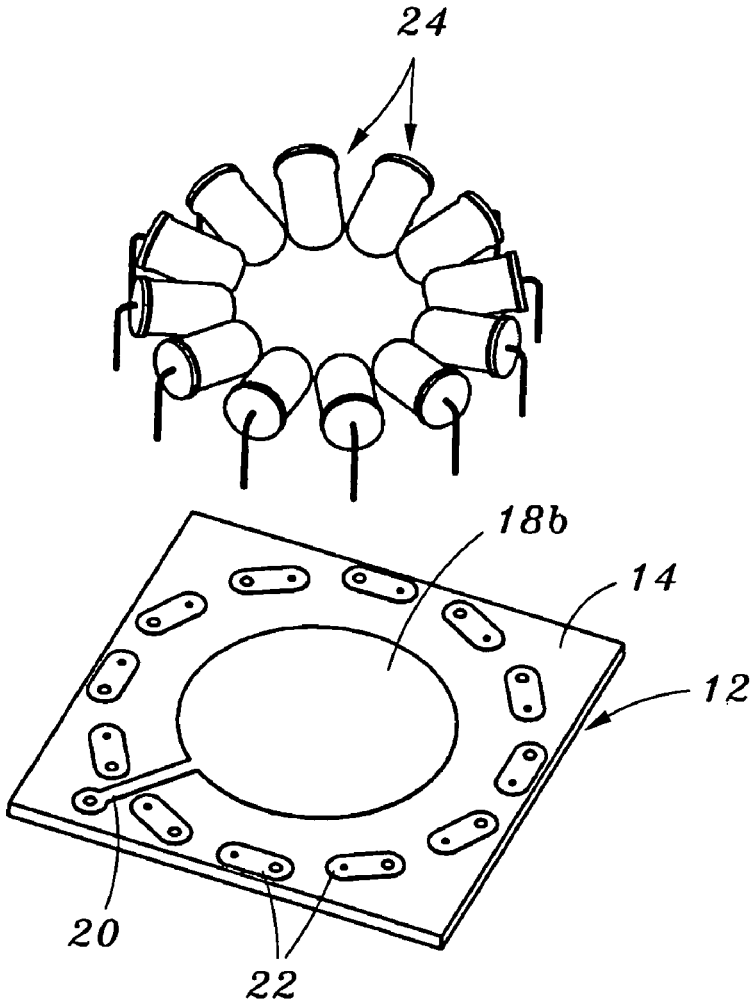
FIG. 15 is an exploded view of the sensor of the third embodiment.

Referring now to FIGS. 12-15, there is shown a sensor 10*b* constructed in accordance with a third embodiment of the present invention. The sensor 10*b* of the third embodiment is similar in structure to the sensor 10 of the first embodiment described above, with the distinction being that the sensor 10*b* includes twelve switches 24 and hence twelve terminals 22, in comparison to the four switches 24 and four terminals 22 included in the sensor 10. In the sensor 10*b*, the terminals 22 are oriented about the pad 18*b* in equidistantly spaced intervals of approximately thirty degrees. Hence, the spacing between the switches 24 in the sensor 10*b* is also approximately thirty degrees. As best seen in FIG. 13, due to the increased number of switches 24 in the senor 10*b*, the area of the pad 18*b* circumvented by the closed inner ends of the bodies 26 of the switches 24 is substantially larger than the comparable area of the pad 18 in the sensor 10. Thus, to ensure that each of the switches 24 in the sensor 10*b* may be placed into conductive contact with the pad 18*b*, the size of the pad 18*b* in the sensor 10*b* is substantially larger than that of the pad 18 in the sensor 10.

As will be recognized, the electronic circuitry with which the sensor 10*b* is used will be adapted to accommodate the additional output signals that will be generated by the sensor 10*b* as a result of the increased number of switches 24 therein. Though not shown, those of ordinary skill in the art will recognize that a further contemplated variant of the sensor 10*b* is one which further includes a thirteenth switch 24 which extends generally perpendicularly relative to the top surface 14 of the base plate 12, and may extend along an axis itself extending generally axially relative to the pad 18*b*. Additionally, though in the sensor 10 four switches are included, and in the sensor 10*b* twelve switches are included, those of ordinary skill in the art will further recognize that sensors including fewer than four switches 24, greater than twelve switches 24, or some number of switches 24 between four and twelve are considered to be within the spirit and scope of the present invention.

Figure 16:
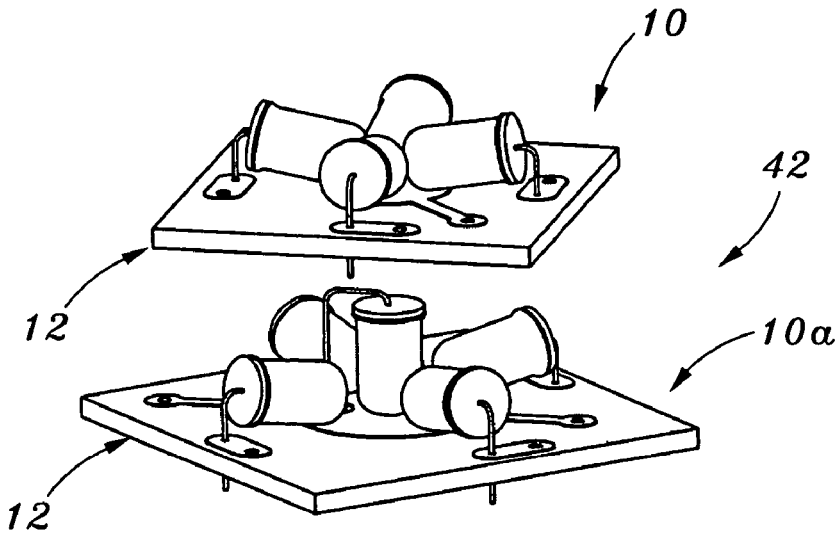
FIG. 16 is a perspective view of a sensor constructed in accordance with a fourth embodiment of the present invention.
Figure 17:
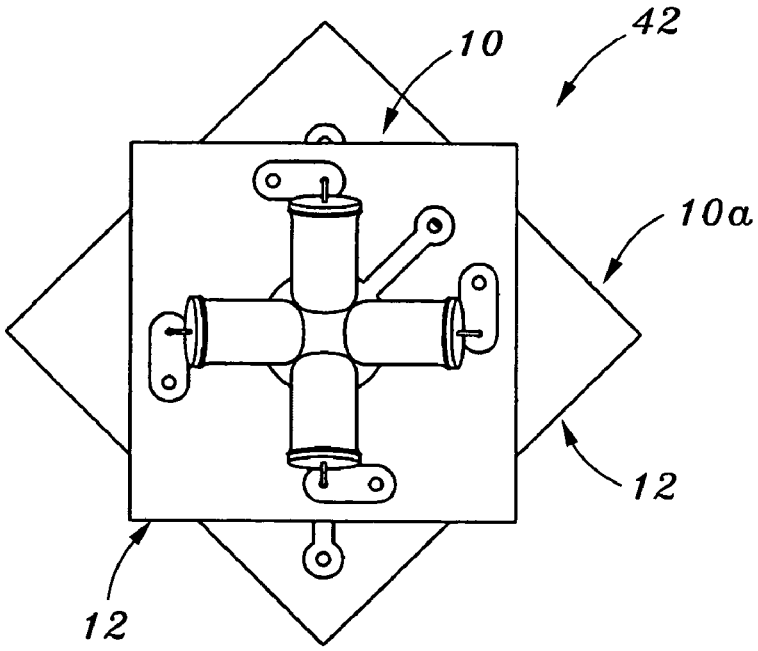
FIG. 17 is a top plan view of the sensor of the fourth embodiment.
Figure 18:
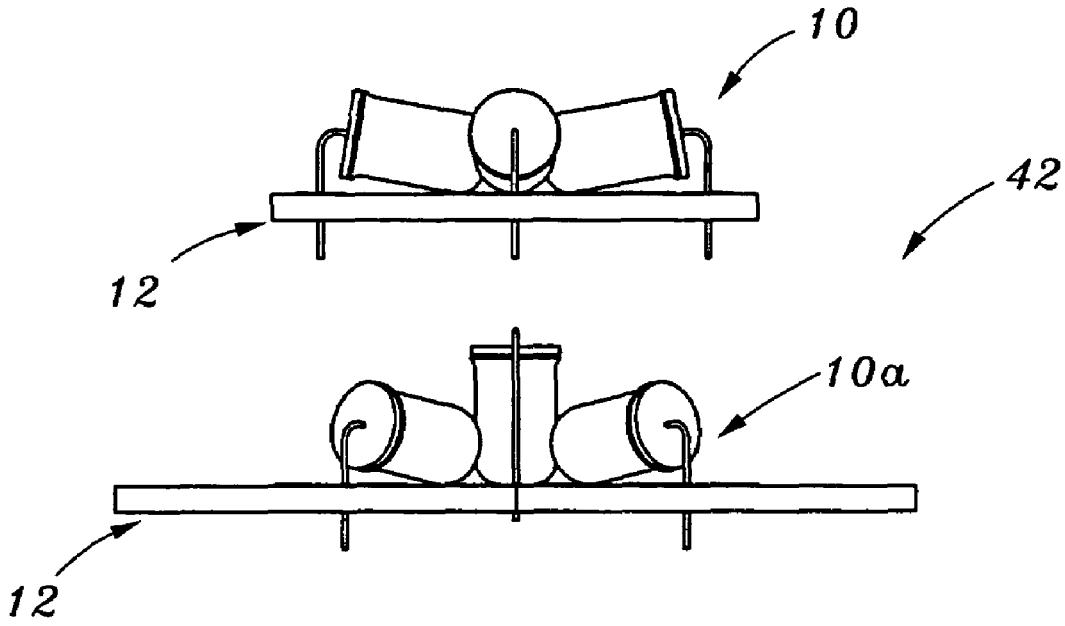
FIG. 18 is a side elevational view of the sensor of the fourth embodiment.

Referring now to FIGS. 16-18, there is shown a sensor 42 constructed in accordance with a fourth embodiment of the present invention. The sensor 42 is essentially an assembly comprising a combination of the sensor 10 of the first embodiment and the sensor 10*a* of the second embodiment. In the sensor 42, the sensors 10, 10*a* are oriented relative to each other such that the switches 24 of the sensors 10, 10*a* (other than for the fifth, central switch 24 of the sensor 10*a*) will be oriented at intervals of approximately forty five degrees relative to each other. To facilitate such orientations, it is contemplated that sensors 10, 10*a* in the sensor 42 will be mounted to either a common support or independent supports such that the base plate 12 of the sensor 10 is offset approximately forty five degrees relative to the base plate 12 of the sensor 10*a*. As will be recognized, the sensor 42 including the combined sensors 10, 10*a* includes substantially increased functionality in comparison to either sensor 10 or sensor 10*a* standing alone.

Figure 19:
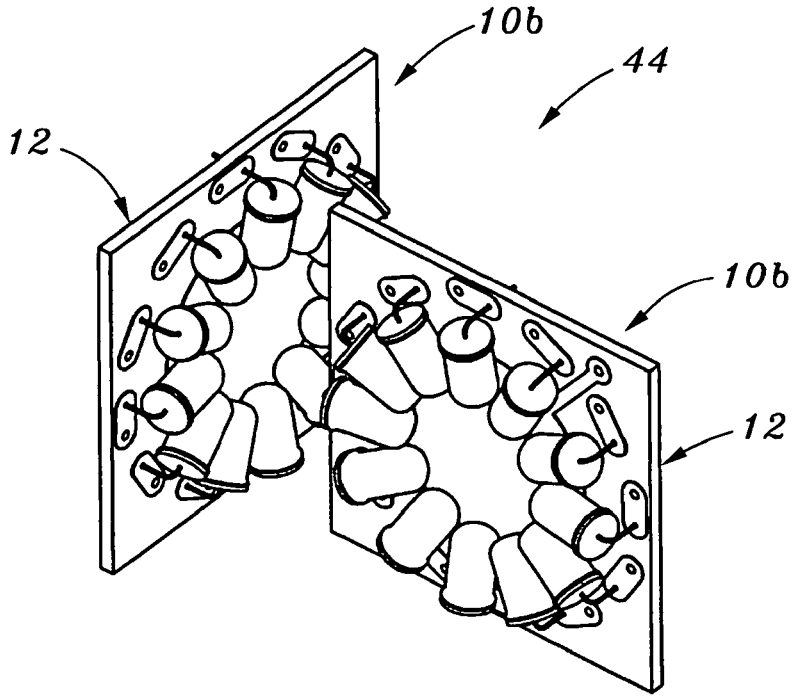
FIG. 19 is a perspective view of a sensor constructed in accordance with a fifth embodiment of the present invention.
Figure 20:
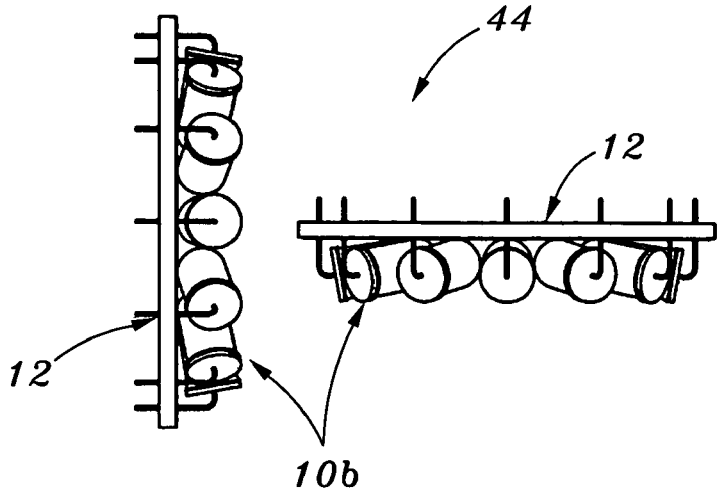
FIG. 20 is a top plan view of the sensor of the fifth embodiment.
Figure 21:
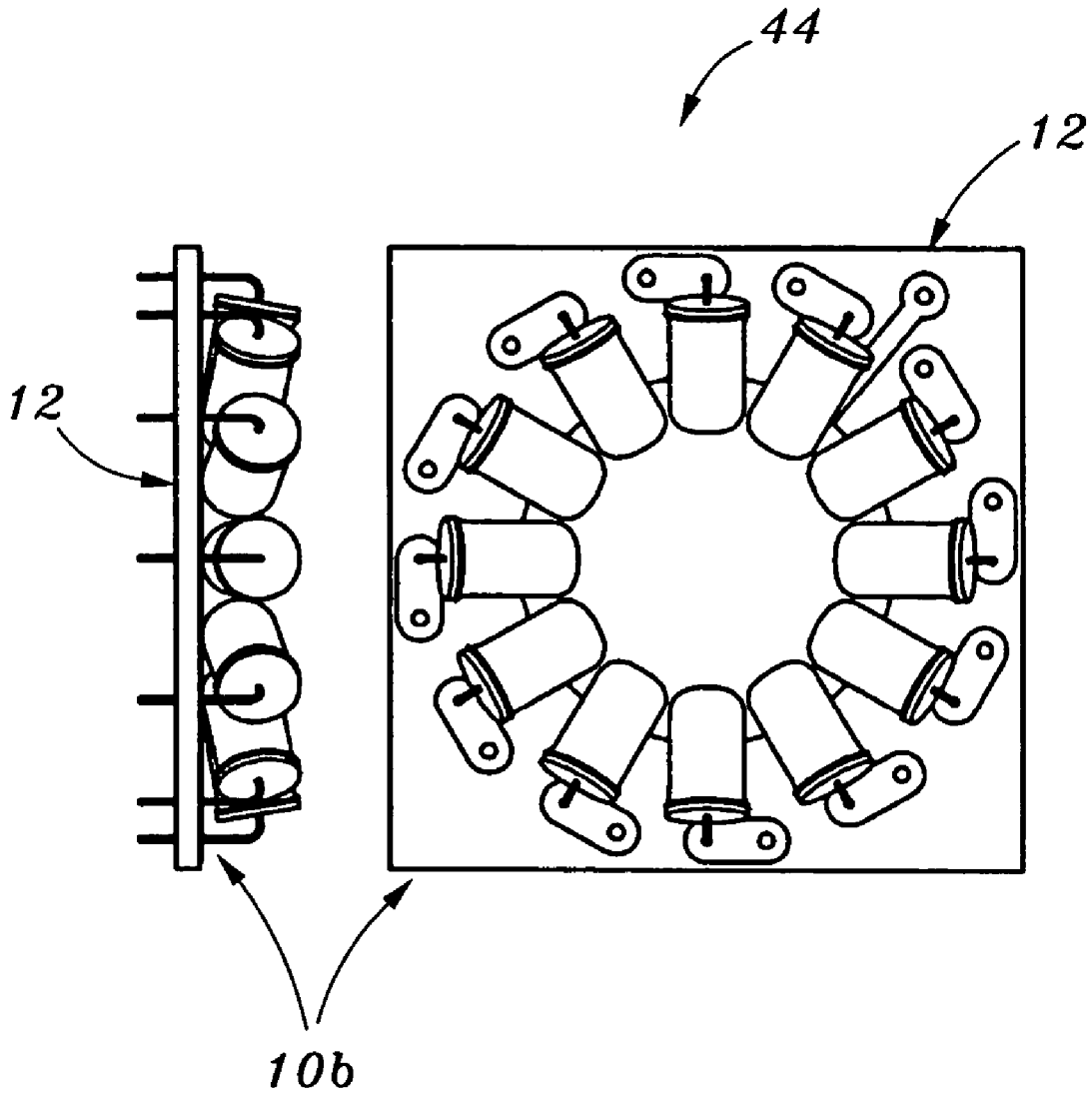
FIG. 21 is a side elevational view of the sensor of the fifth embodiment.
Figure 22:
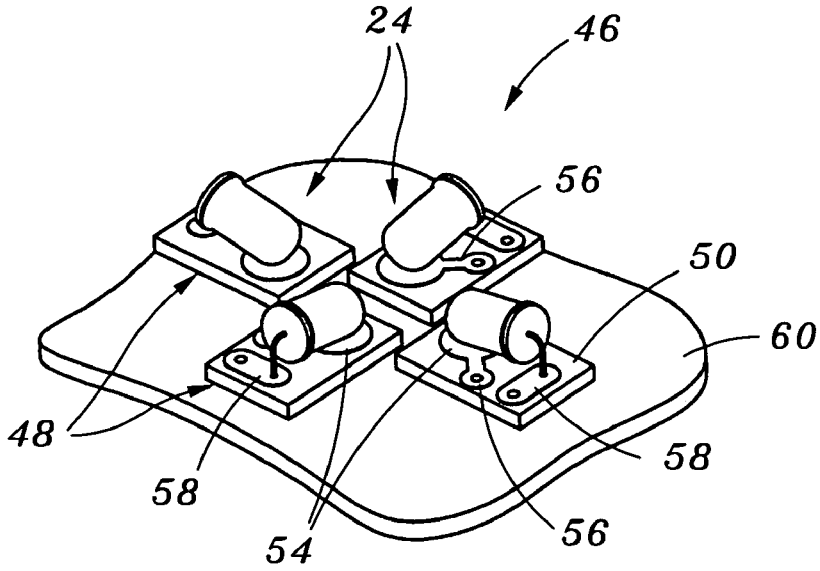
FIG. 22 is a top perspective view of a sensor constructed in accordance with a sixth embodiment of the present invention.
Figure 23:
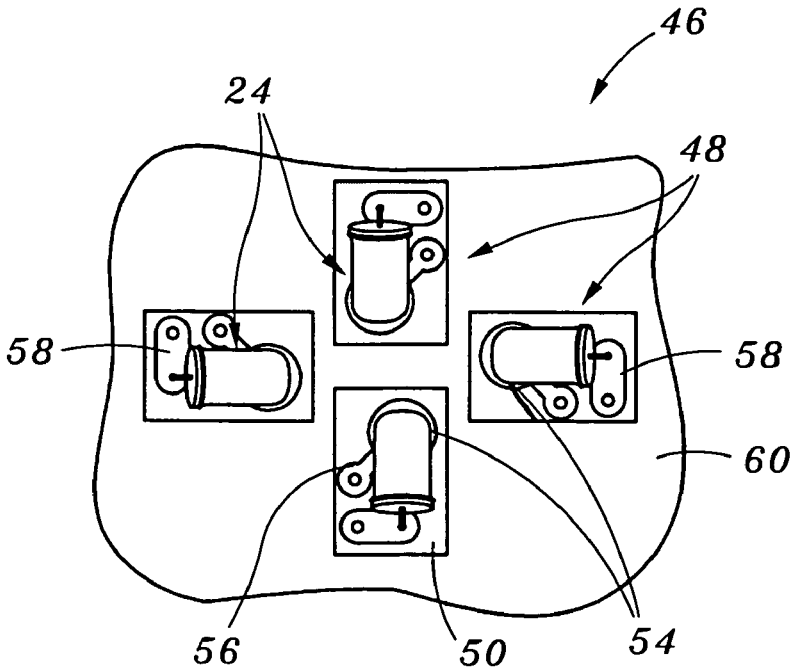
FIG. 23 is a top plan view of the sensor of the sixth embodiment.
Figure 24:
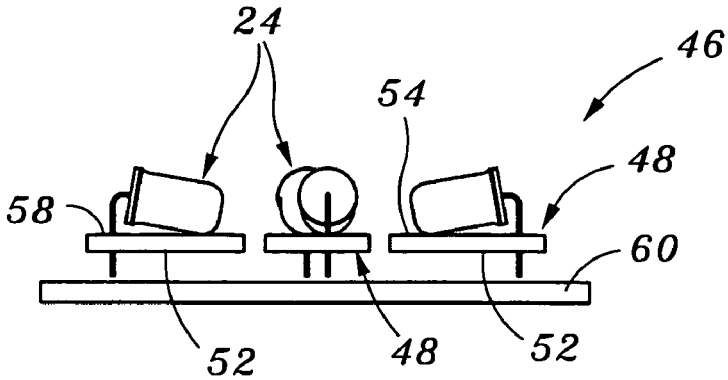
FIG. 24 is a side elevational view of the sensor of the sixth embodiment.
Figure 25:
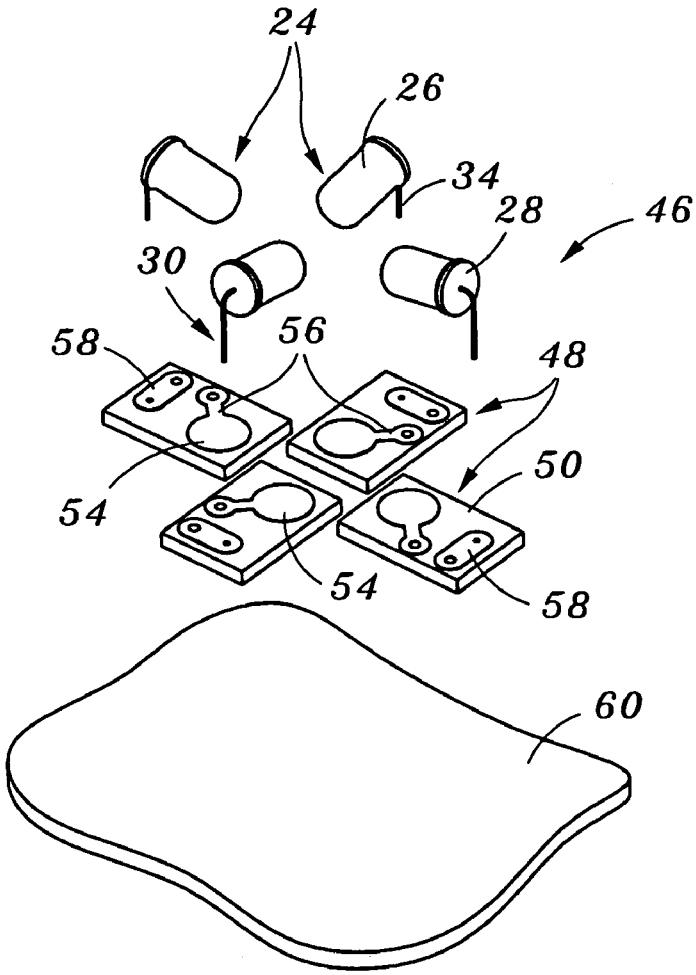
FIG. 25 is an exploded view of the sensor of the sixth embodiment.

Referring now to FIGS. 19-21, there is shown a sensor 44 constructed in accordance with a fifth embodiment of the present invention. Like the sensor 42, the sensor 44 is also actually an assembly consisting of a pair of the sensors 10*b* of the third embodiment placed in prescribed orientations relative to each other. More particularly, as is seen in FIGS. 19-21, the sensors 10*b* included in the sensor 44 are oriented relative to each other such that the base plate 12 of one of the sensors 10*b* extends generally perpendicularly relative to the base plate 12 of the remaining sensor 10*b*. As described above in relation to the other embodiments of the sensor, the electronic circuitry used in conjunction with the sensor 44 could be adapted to accommodate the numerous combinations of output signals which could be generated by the sensor 44. Though not shown, those of ordinary skill in the art will recognize that a sensor may be constructed including a pair of the sensors 10 of the first embodiment which are oriented relative to each other in the same manner as the sensors 10*b* of the sensor 44.

It is contemplated that in each of the above-described embodiments of the present invention, the switches 24 may be mounted to separate substrates (e.g., separate printed circuit boards), as opposed to groups of the switches 24 with the same respective orientation being mounted to a common substrate. More particularly, referring now to FIGS. 22-25, there is shown a sensor 46 constructed in accordance with a sixth embodiment of the present invention. Like the sensor 10 of the first embodiment described above, the sensor 46 includes four switches 24. However, the switches 24, rather than being attached to the common base plate as described in relation to the sensor 10, are attached to respective ones of four separate base members 48. Each of the base members 48 preferably has a generally quadrangular configuration. Each base member 48 further defines a generally planar top surface 50 and an opposed, generally planar bottom surface 52. Formed on the top surface 50 of each base member 48 is a circularly configured conductive pad 54. Integrally connected to and extending radially from the pad 54 of each base member 48 is an elongate conductive trace 56, the distal end of which has an enlarged, generally circular configuration. Also disposed on the top surface 50 of each base member 48 is an elongate, conductive terminal 58. The pad 54, trace 56 and terminal 58 of each base member 48 are each preferably fabricated from a conductive metallic material, such as copper. The formation of the pad 54, trace 56 and terminal 58 may be facilitated through the completion of a conventional etching process subsequent to the application of a metal layer to the top surface 50 of each base member 48. The base member 48 is itself preferably fabricated from a non-conductive, insulative material.

In the sensor 46, each switch 24 is attached to a respective base member 48 such that that portion of the body 26 of each switch 24 adjacent the closed end thereof is brought into direct, abutting contact with the pad 54 of the corresponding base member 48. Additionally, the pin portion 34 of the contact pin 30 of each switch 24 is bent and advanced through an aperture which extends through the corresponding base member 48 and terminal 58. The pin portion 34 of each contact pin 30 is conductively secured to the terminal 58 of a respective base member 48 such that the open end of the body 26 which is enclosed by the plug 28 is slightly elevated relative to the top surface 50 of the base member 48 in the manner best shown in FIG. 24. Thus, the body 26 of each switch 24 extends slightly angularly upwardly from the corresponding base member 48.

In the sensor 46 of the sixth embodiment, the separate base members 48 (which each include a switch 24 interfaced thereto in the above-described manner) are preferably attached to a common support or platform 60. Such platform 60 may actually comprise a toy or other device into which the sensor 46 is integrated. Those of ordinary skill in the art will recognize that the platform 60 need not necessarily be a unitary structure, but may consist of multiple structures which are interfaced to each other so as to concurrently move with each other. In this regard, all that is necessary is that the switches 24 and corresponding base members 48 always move concurrently when the toy or other device into which the sensor 46 is integrated is moved or shifted relative to a reference plane. The base members 48 are preferably attached to the platform 60 such that switches 24 are spaced from each other at intervals of approximately ninety degrees.

The sensor 46 of the sixth embodiment functions in essentially the same manner described above in relation to the sensor 10, the movement of the base members 48 out of parallel relation to a reference plane causing the actuation ball 36 of at least one of the switches 24 to roll away from the closed end of the corresponding body 26 and into contact with the inner end 32 of the corresponding contact pin 30. When such contact occurs, a continuous conductive path is created, such path being defined by the conductive contact between the pad 54 and the body 26, the conductive contact between the body 26 and the actuation ball 36, the conductive contact between the actuation ball 36 and the inner end 32 of the contact pin 30, and the conductive contact between the pin portion 34 of the contact pin 30 and the corresponding terminal 58. Depending on the manner in which the base members 48 are tilted or shifted out of parallel relation to the reference plane, the actuation ball 36 of at least one of the switches 24 may be brought into conductive contact with a corresponding one of the contact pins 30. Thus, the sensor 46, like the sensor 10, has the capability of generating a multiplicity of different conditions or states depending on the angular displacement of the platform 60 (and hence the base members 48) relative to the reference plane. When the platform 60 (and hence the base members 48) is in a neutral position and thus disposed in substantially parallel relation to the reference plane, no output signal is generated by the sensor 46 due to the absence of conductive communication between the actuation balls 36 and terminals 58. However, the shifting of the position of the platform 60 (and hence the base members 48) relative to the reference plane will cause one or more different output signals to be generated by the sensor 46, depending on which actuation ball(s) 36 are brought into conductive contact with the corresponding control pin(s) 30. The sensor 46 is preferably used in conjunction with electronic circuitry which has the functional capability of producing certain visual and/or audible effects, depending on which output signal(s) are transmitted thereto from the sensor 46.

Referring now to FIGS. 26-29, there is shown a sensor 46*a* constructed in accordance with a seventh embodiment of the present invention. The sensor 46*a* is similar in structure and function to the sensor 46 of the sixth embodiment described above. Thus, only the distinctions or variations between the sensors 46, 46*a* will be discussed below.

Figure 26:
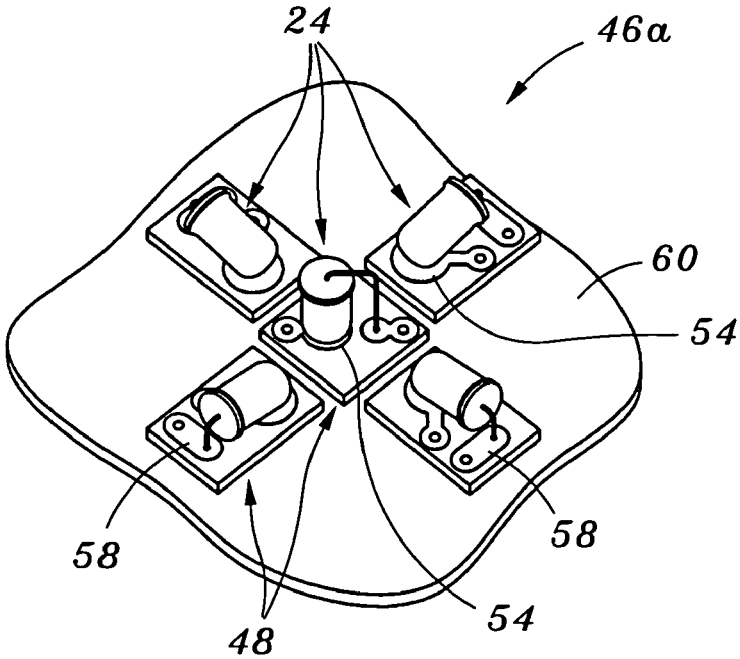
FIG. 26 is a top perspective view of a sensor constructed in accordance with a seventh embodiment of the present invention.
Figure 27:
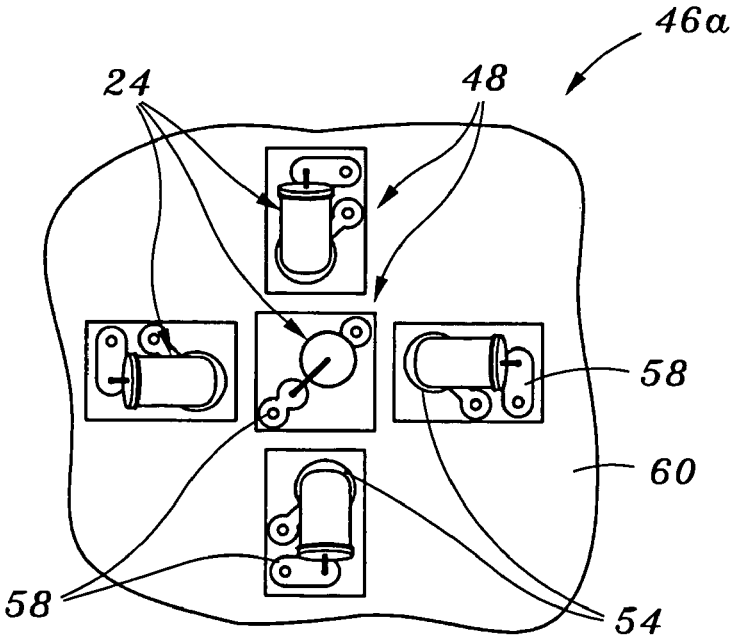
FIG. 27 is a top plan view of the sensor of the seventh embodiment.
Figure 28:
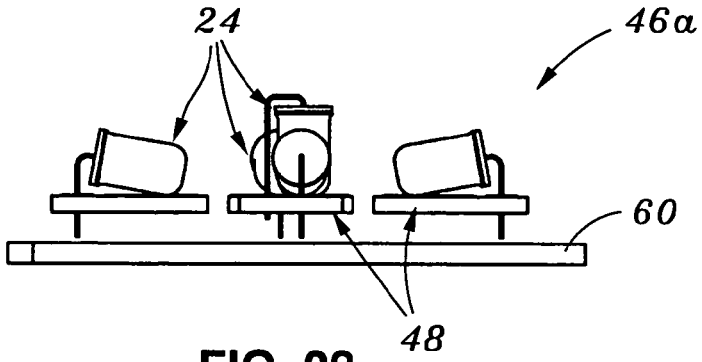
FIG. 28 is a side elevational view of the sensor of the seventh embodiment.
Figure 29:
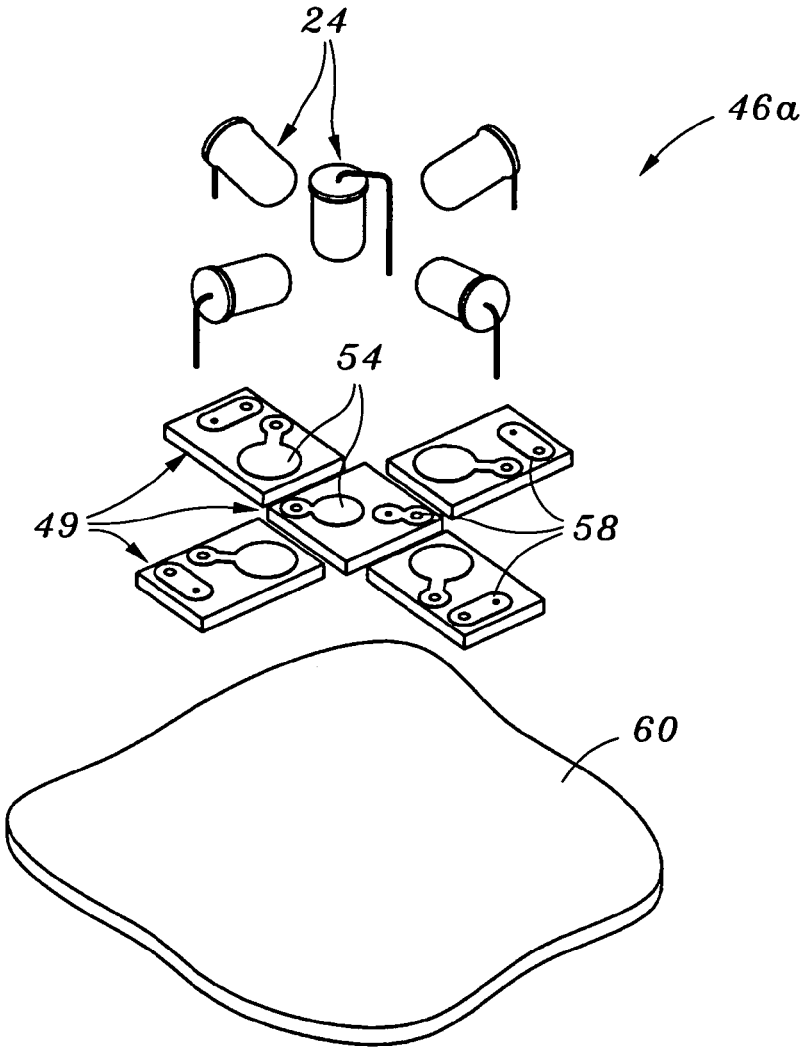
FIG. 29 is an exploded view of the sensor of the seventh embodiment.

The primary distinction between the sensor 46*a* of the seventh embodiment and the sensor 46 of the sixth embodiment is the inclusion of five switches 24 in the senor 46*a*, in comparison to the four switches 24 included in the sensor 46. In the sensor 46*a*, an extra fifth switch 24 is oriented so as to extend along an axis which itself extends generally perpendicularly relative to that surface of the platform 60 to which the base members 48 of the remaining four switches 24 are mounted. The fifth switch 24, like the remaining four switches 24, is mounted to its own base member 48. In the sensor 46*a*, the closed end of the body 26 of the fifth switch 24 directly abuts the pad 54 of its corresponding base member 48. In the sensor 46*a*, the configuration of the trace 58 included on the base member 48 used to accommodate the fifth switch 54 differs slightly from that of the traces 58 included on the base members 48 which accommodate the remaining four switches 24. As seen in FIGS. 26, 27 and 29, to accommodate the fifth switch 24 in the sensor 46*a*, the base members 48 of the remaining four switches 24 are spaced from each other to create a central gap or opening of sufficient size for the base member 48 of the fifth switch 24. However, those of ordinary skill in the art will recognize that the base member 48 of the fifth switch 24 need not necessarily be oriented between the remaining four base members 48.

The functionality of the sensor 46*a* of the seventh embodiment is similar to that described above in relation to the sensor 46 of the sixth embodiment. However, the sensor 46*a*, due to its inclusion of the fifth switch 24, has the additional capability of distinguishing whether the sensor 46*a* is right side up or upside down relative to a reference plane, in the same manner described above in relation to the functionality of the senor 10*a* of second embodiment.

Figure 30:
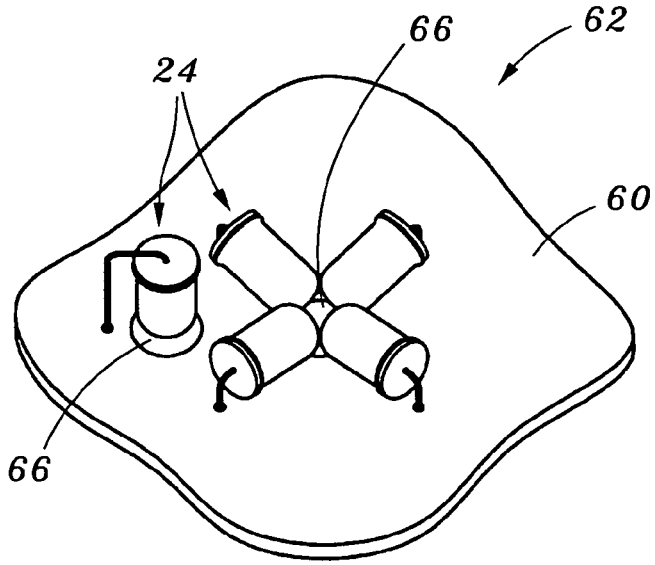
FIG. 30 is a top perspective view of a sensor constructed in accordance with an eighth embodiment of the present invention.
Figure 33:
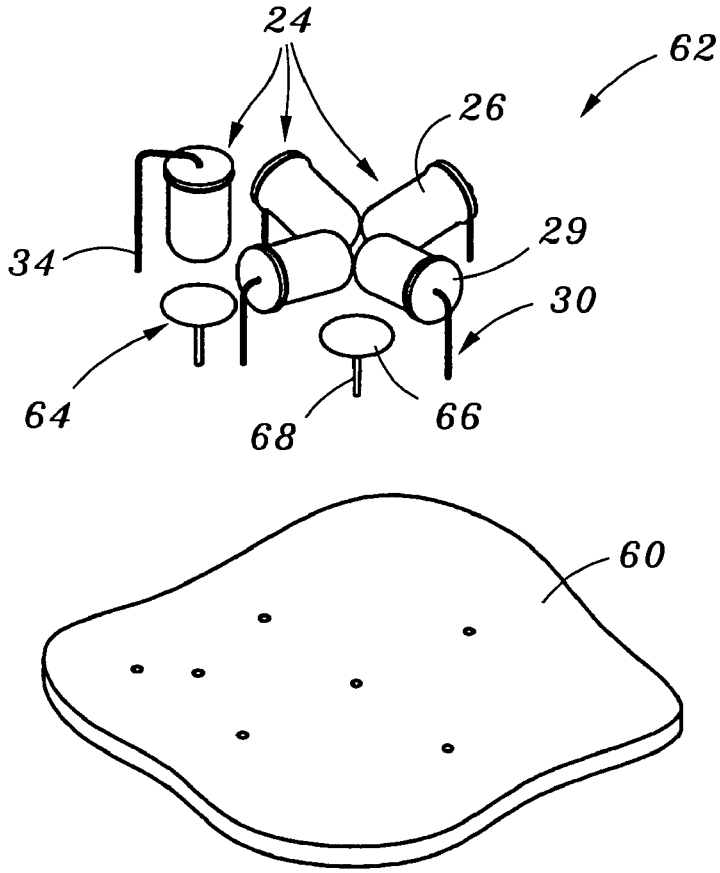
FIG. 33 is an exploded view of the sensor of the eighth embodiment.
Figure 34:
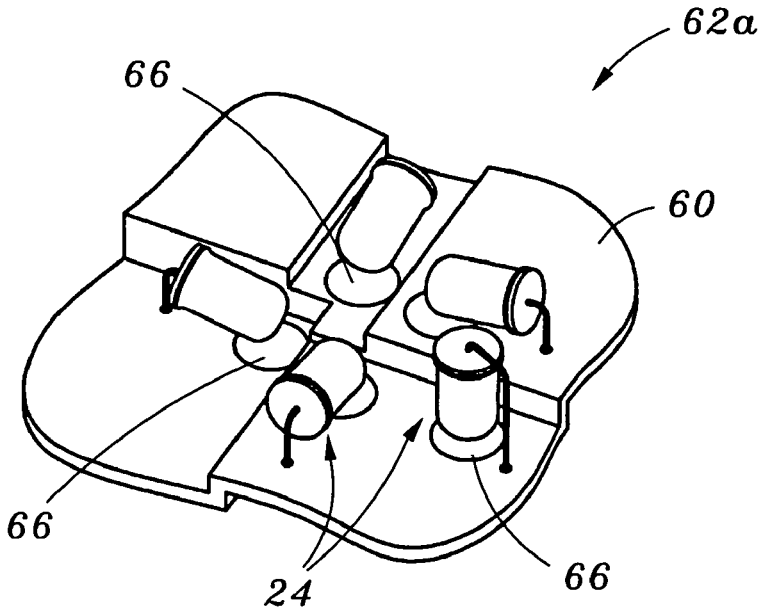
FIG. 34 is a top perspective view of a sensor constructed in accordance with a ninth embodiment of the present invention.
Figure 35:
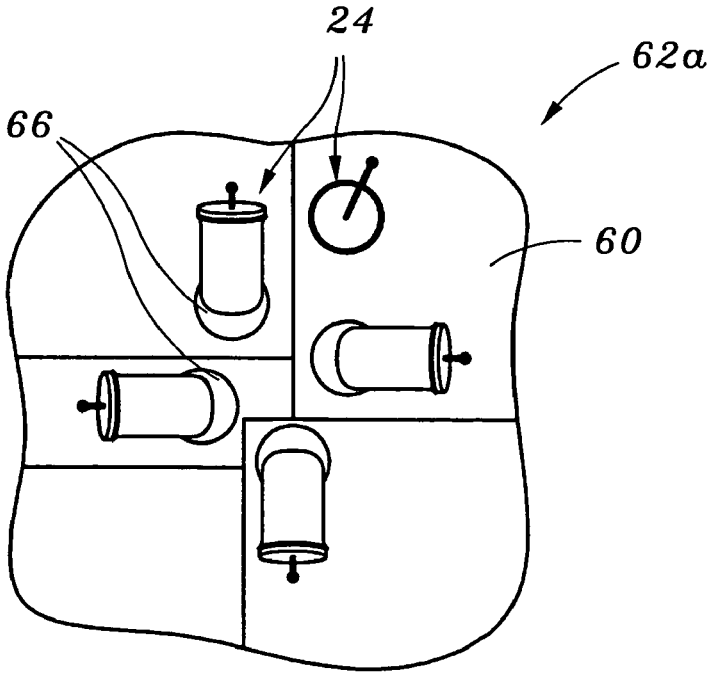
FIG. 35 is a top plan view of the sensor of the ninth embodiment.
Figure 36:
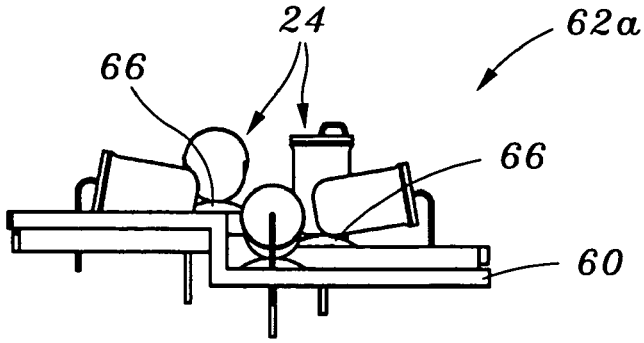
FIG. 36 is a side elevational view of the sensor of the ninth embodiment.
Figure 37:
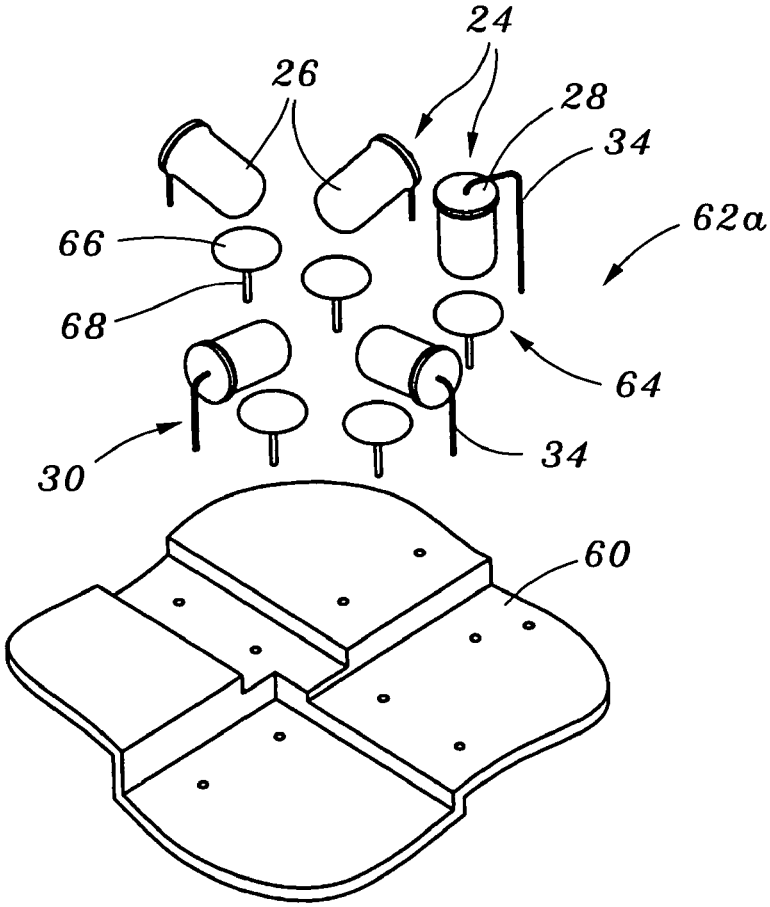
FIG. 37 is an exploded view of the sensor of the ninth embodiment.

Referring now to FIGS. 30-33, there is shown a sensor 62 constructed in accordance with an eighth embodiment of the present invention. The sensor 62 is similar to the sensor 46*a* of the seventh embodiment, except that the base members 48 of the sensor 46(*a*) are completely eliminated, the switches 24 of the sensor 62 being directly interfaced to a common surface of the platform 60. In this regard, as best seen in FIGS. 30 and 33, interfaced to the platform 60 is an identically configured pair of contact members 64. Each of the contact members 64 has an enlarged, circularly configured pad portion 66 and an elongate pin portion 68 which extends axially from one side of the pad portion 66. The pin portions 68 of the contact members 64 are advanced through respective, complimentary apertures within the platform 60 such that the pad portions 66 reside upon a common surface of the platform 60 in the manner shown in FIG. 30.

Figure 31:
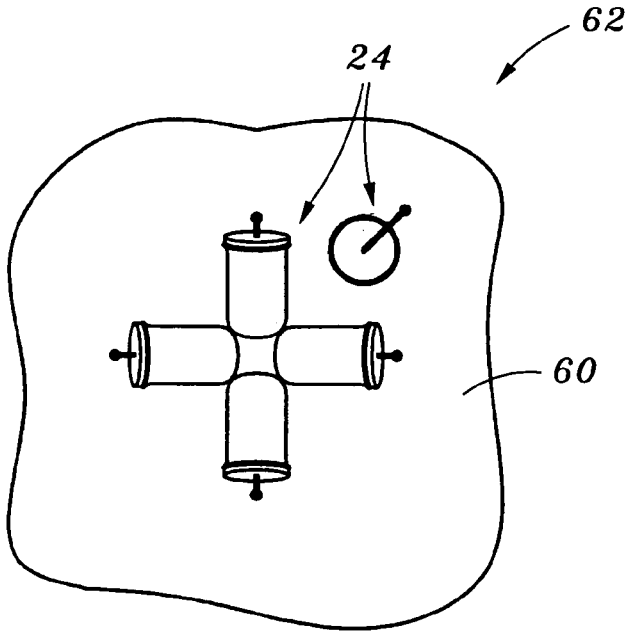
FIG. 31 is a top plan view of the sensor of the eighth embodiment.
Figure 32:
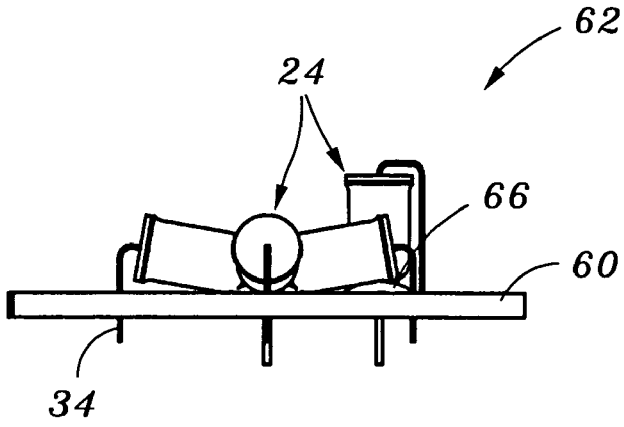
FIG. 32 is a side elevational view of the sensor of the eighth embodiment.

Subsequent to the interface of the contact members 64 to the platform 60, the five switches 24 of the sensor 62 are themselves interfaced to the platform 60. More particularly, the pin portions 34 of all five switches 24 are advanced through respective, complimentary apertures disposed within the platform 60. As seen in FIGS. 30, 31 and 33, four of the switches 24 are oriented at intervals of approximately ninety degrees relative to each other, with portions of the bodies 26 of such switches 24 adjacent the closed ends thereof abutting the pad portion 66 of one of the contact members 64. The closed end of the body 26 of the fifth switch 24 directly abuts the pad portion 66 of the remaining contact member 64. In the sensor 62, the fifth switch 24 is not disposed between the remaining four switches 24, but rather outward thereof. The functionality of the sensor 62 essentially mimics that of the sensor 10*a* of the second embodiment and the sensor 46*a* of the seventh embodiment.

Referring now to FIGS. 34-37, there is shown a sensor 62*a* constructed in accordance with a ninth embodiment of the present invention. The sensor 62*a* is similar in structure and function to the sensor 62 of the eighth embodiment described above. Thus, only the distinctions or variations between the sensors 62, 62*a* will be discussed below.

The primary distinction between the sensor 62*a* of the ninth embodiment and the sensor 62 of the eighth embodiment is that in the sensor 62*a*, each of the five switches 24 is in conductive contact with the pad portion 66 of its own contact member 64. In this regard, the sensor 62*a* includes a total of five contact members 64 corresponding to respective ones of the five switches 24. The inclusion of these five separate contact members 64 in the sensor 62*a* is occasioned by the lack or absence of a uniform, planar surface of the platform 60 to which all the switches 24 may be mounted. To accommodate the differing elevations of the platform 60, each switch 24 is conductively interfaced to its own discreet contact member 64, the switches 24 ultimately being oriented at differing elevations relative to each other in the manner shown in FIGS. 34 and 36. Despite these differing elevations, the functionality of the sensor 62*a* of the ninth embodiment mimics that of the sensor 62 of the eighth embodiment.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A sensor for use in an interactive electronic device, the sensor comprising:

a base plate having at least one pad and at least two terminals disposed thereon; and at least two switches attached to the base plate, each of the switches being electrically connected to the pad and to respective ones of the terminals;

the sensor being operative to generate different output signals corresponding to respective positions of the base plate relative to a reference plane, each of the output signals being generated by the creation of a conductive path between the pad and at least one of the terminals by at least one of the switches.

2. The sensor of claim 1 wherein:

four switches are attached to a common side of the base plate at intervals of approximately ninety degrees; and each of the switches is electrically connected to the pad and to a respective one of four terminals disposed on the base plate.

3. The sensor of claim 1 wherein:

twelve switches are attached to a common side of the base plate at intervals of approximately thirty degrees; and each of the switches is electrically connected to the pad and to a respective one of twelve terminals disposed on the base plate.

4. The sensor of claim 1 wherein:

the base plate defines at least one generally planar plate surface; and at least one of the switches is oriented so as to extend along a switch axis which extends generally perpendicularly relative to the plate surface.

5. The sensor of claim 4 wherein:

four switches are attached to a common side of the base plate at intervals of approximately ninety degrees;

a fifth switch is attached to the common side of the base plate and oriented so as to extend along the switch axis; and each of the switches is electrically connected to the pad and to a respective one of five terminals disposed on the base plate.

6. The sensor of claim 1 wherein each of the switches comprises:

a tubular body having an open end and a closed end;

a plug attached to the body and enclosing the open end thereof, the body and the plug collectively defining an interior chamber;

at least one actuation ball disposed in the interior chamber; and a contact pin extending through the plug, a portion of the contact pin residing in the interior chamber;

the contact pin, the body and the actuation ball each being fabricated from a conductive metal material, the body being electrically connected to the pad, and a portion of the contact pin being electrically connected to a respective one of the terminals, the actuation ball being selectively placeable into simultaneous electrical contact with the body and the contact pin.

7. The sensor of claim 6 wherein at least one of the actuation ball and the contact pin is fabricated from a ferromagnetic material.

8. The sensor of claim 6 wherein:

the base plate defines a generally planar plate surface; and each of the switches is attached to the plate surface such that the body thereof is angularly oriented relative thereto in a manner wherein the actuation balls do not contact any of the contact pins when the base plate is oriented in generally parallel relation to the reference plane.

9. A sensor assembly for use in an interactive electronic device, the sensor assembly comprising:

a first sensor comprising:

a first base plate defining a generally planar first plate surface and having at least one pad and at least five terminals disposed on the first plate surface;

four switches attached to the first plate surface at intervals of approximately ninety degrees; and a fifth switch attached to the first plate surface and oriented so as to extend along a switch axis which extends generally perpendicularly relative to the first plate surface;

each of the switches of the first sensor being electrically connected to the pad and to respective ones of the five terminals thereof;

a second sensor comprising:

a second base plate defining a generally planar second plate surface and having at least one pad and at least four terminals disposed on the second plate surface; and four switches attached to the second plate surface at intervals of approximately ninety degrees, each of the switches of the second sensor being electrically connected to the pad and to respective ones of the four terminals thereof;

the second base plate of the second sensor being offset at an angle of approximately forty five degrees relative to the first base plate of the first sensor such that the four switches of each of the first and second sensors are oriented at intervals of approximately forty five degrees relative to each other, the sensor assembly being operative to generate different output signals corresponding to respective positions of the first and second base plates relative to a reference plane, each of the output signals being generated by the creation of a conductive path between at least one of the pads and at least one of the terminals by at least one of the switches.

10. The sensor assembly of claim 9 wherein the switches of the first and second sensors each comprise:

a tubular body having an open end and a closed end;

a plug attached to the body and enclosing the open end thereof, the body and the plug collectively defining an interior chamber;

at least one actuation ball disposed in the interior chamber; and a contact pin extending through the plug, a portion of the contact pin residing in the interior chamber;

the contact pin, the body and the actuation ball each being fabricated from a conductive metal material, the body being electrically connected to a respective one of the pads, and a portion of the contact pin being electrically connected to a respective one of the terminals, the actuation ball being selectively placeable into simultaneous electrical contact with the body and the contact pin.

11. The sensor assembly of claim 10 wherein at least one of the actuation ball and the contact pin is fabricated from a ferromagnetic material.

12. The sensor assembly of claim 9 wherein:

the four switches of each of the first and second sensors are attached to respective ones of the first and second plate surfaces such that the bodies thereof are angularly oriented relative thereto in a manner wherein the actuation balls do not contact any of the contact pins when the first and second base plates are oriented in generally parallel relation to the reference plane.

13. A sensor assembly for use in an interactive electronic device, the sensor assembly comprising:

a first and second sensors which each comprise:

a base plate defining a generally planar plate surface and having at least one pad and a plurality of terminals disposed on the plate surface;

a plurality of switches attached to the plate surface at prescribed intervals, each of the switches being electrically connected to the pad and to respective ones of the terminals;

the plate surface of the base plate of the second sensor extending generally perpendicularly relative to the plate surface of the base plate of the first sensor, the sensor assembly being operative to generate different output signals corresponding to respective positions of the first and second base plates relative to a reference plane, each of the output signals being generated by the creation of a conductive path between at least one of the pads and at least one of the terminals by at least one of the switches.

14. The sensor assembly of claim 13 wherein:

at least twelve terminals are disposed on the plate surface; and twelve switches are attached to the plate surface at intervals of approximately thirty degrees, each of the switches being electrically connected to the pad and to respective ones of the twelve terminals.

15. The sensor assembly of claim 13 wherein the switches of the first and second sensors each comprise:

a tubular body having an open end and a closed end;

a plug attached to the body and enclosing the open end thereof, the body and the plug collectively defining an interior chamber;

at least one actuation ball disposed in the interior chamber; and a contact pin extending through the plug, a portion of the contact pin residing in the interior chamber;

the contact pin, the body and the actuation ball each being fabricated from a conductive metal material, the body being electrically connected to a respective one of the pads, and a portion of the contact pin being electrically connected to a respective one of the terminals, the actuation ball being selectively placeable into simultaneous electrical contact with the body and the contact pin.

16. The sensor assembly of claim 15 wherein at least one of the actuation ball and the contact pin is fabricated from a ferromagnetic material.

17. The sensor assembly of claim 13 wherein:

the switches of each of the first and second sensors are attached to respective ones of the plate surfaces such that the bodies thereof are angularly oriented relative thereto.

18. A sensor for use in an interactive electronic device, the sensor comprising:

a platform having at least one conductive pad disposed thereon; and at least two switches attached to the platform, each of the switches being electrically connected to the pad;

the sensor being operative to generate different output signals corresponding to respective positions of the platform relative to a reference plane, each of the output signals being generated by the creation of a conductive path between the pad and at least one of the switches.

19. The sensor of claim 18 wherein the platform comprises a portion of the interactive electronic device.

20. The sensor of claim 18 wherein:

the platform has at least two conductive pads disposed thereon; and the switches are electrically connected to respective ones of the pads.

21. The sensor of claim 20 wherein the conductive pads reside on respective ones of at least two generally parallel planes.

22. A sensor for use in an interactive electronic device, the sensor comprising:

at least two base members, each of the base members having at least one pad and at least one terminal disposed thereon; and at least two switches attached to respective ones of the base members, each of the switches being electrically connected to the pad and to the terminal of one of the base members;

the base members of the sensor being attached to a common platform, with the sensor being operative to generate different output signals corresponding to respective positions of the platform relative to a reference plane, each of the output signals being generated by the creation of a conductive path between at least one of the pads and at least one of the terminals by at least one of the switches.

23. The sensor of claim 22 wherein the platform comprises a portion of the interactive electronic device.

* * * * *